United States Patent [19]

Rye et al.

[11] Patent Number: 4,545,190

[45] Date of Patent: Oct. 8, 1985

[54] METALLIC CABLE AND METHOD AND APPARATUS FOR MAKING SAME

[75] Inventors: Grover W. Rye, Cuyahoga Falls; Kenneth J. Palmer, Wadsworth, both of Ohio

[73] Assignee: The Goodyear Tire & Rubber Company, Akron, Ohio

[21] Appl. No.: 535,473

[22] Filed: Sep. 26, 1983

[51] Int. Cl.[4] ..... D02G 3/48; D02G 3/12; D07B 1/00; D07B 3/12

[52] U.S. Cl. ..... 57/212; 57/6; 57/9; 57/58.36; 57/58.52; 57/58.57; 57/58.59; 57/236; 57/311; 57/902

[58] Field of Search ..... 57/212, 9, 902, 236, 57/58.3, 58.36, 6, 58.52, 58.57, 211, 58.59, 311, 314

[56] References Cited

U.S. PATENT DOCUMENTS

| | | | |
|---|---|---|---|
| 3,273,978 | 9/1966 | Paul | 57/902 X |
| 4,022,009 | 5/1977 | van Assendelft | 57/212 |
| 4,030,248 | 6/1977 | van Assendelft | 57/212 X |

*Primary Examiner*—John Petrakes
*Attorney, Agent, or Firm*—L. R. Drayer

[57] ABSTRACT

A metallic cable comprises a strand of identical helical shaped filaments positioned beside and against each other such that each filament of the strand is in line contact with at least one other filament of the strand. The helixes of the filaments of the strand are sloped in a first direction. A single filament is twisted with the strand in a direction opposite to said first direction. An apparatus and a method for manufacturing the metallic cable are also disclosed.

16 Claims, 8 Drawing Figures

METALLIC CABLE AND METHOD AND APPARATUS FOR MAKING SAME

BACKGROUND OF THE INVENTION

The present invention relates generally to metallic cables, and more particularly to metallic cables that are useful for reinforcing elastomeric articles such as tires, hoses and belts. A method and apparatus for manufacturing a metallic cable according to the invention are also disclosed.

One of the problems that may be encountered in elastomeric articles reinforced with metallic cables is the propagation of corrosion along the length of the cable in the event that the article is cut or torn so that the cable is exposed. One approach to solving the problem of corrosion propagation has been to make a cable very compact with no interstices between the filaments and strands of the cable, therefore leaving no pathway along which corrosion may spread. A second approach has been to make a cable with a very open construction, such that the elastomeric material in which the cable is embedded can penetrate the cable and substantially surround each individual filament. The present invention is concerned with the latter approach.

BRIEF DESCRIPTION OF THE DRAWINGS

The features of the present invention which are believed to be novel are set forth with particularlity in the appended claims. The present invention, both as to its structure and manner of operation, may best be understood by reference to the following description, taken in accordance with the accompanying drawings in which:

DETAILED DESCRIPTION OF THE INVENTION

Figure 1:
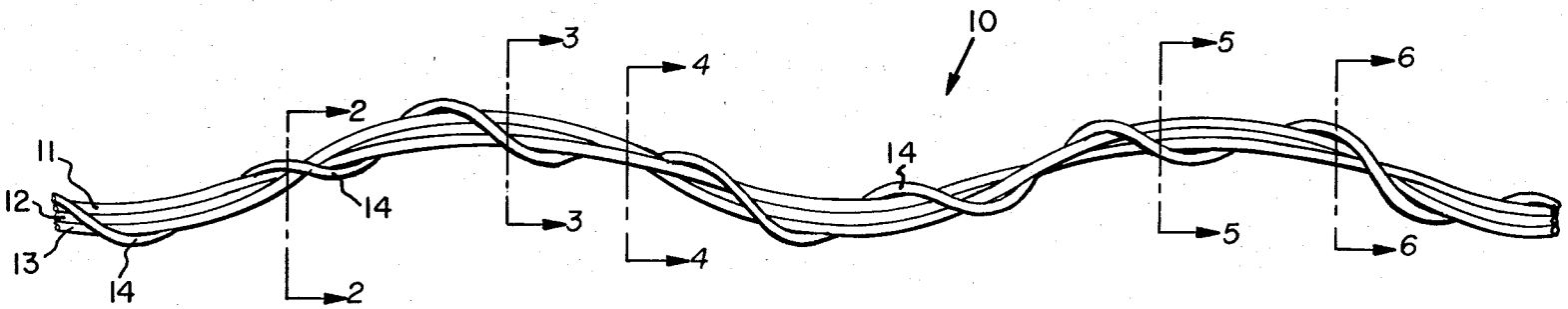
FIG. 1 is a side elevational view of a metallic cable according to the invention.
Figure 2:
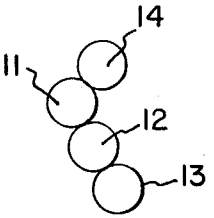
FIGS. 2 to 6 are cross-sectional views taken along lines 2—2 to 6—6, respectively, of FIG. 1.
Figure 3:
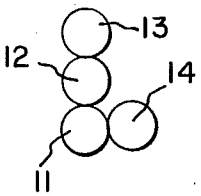
Figure 4:
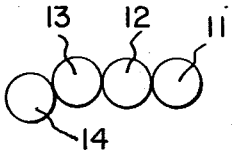
Figure 5:
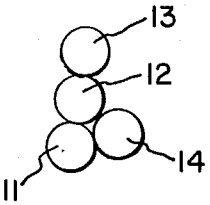
Figure 6:
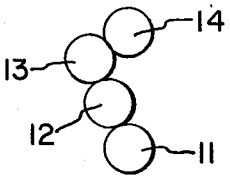

Referring to FIG. 1, there is shown a side elevation view of a metallic cable 10 in accordance with the invention. The cable 10 comprises a plurality of identical helically shaped untwisted filaments 11,12,13 positioned beside and against each other such that each filament is in line contact with at least one other of the untwisted filaments. The helixes of the plurality of filaments are twisted in a given direction, depending upon the wishes of the engineer designing the elastomeric article which will be reinforced by the elastomeric cable.

As used herein, a filament refers to an individual metallic wire; a "strand" refers to a group of filaments combined together to form a unit; and a "cable" refers to a structure comprising two or more strands, or a combination of at least one strand with at least one filament. The plurality of untwisted filaments 11,12,13 may be properly referred to as a strand. While three untwisted filaments are shown in FIGS. 1 to 6, it is understood that two or more untwisted filaments may be used in a metallic cable according to the invention.

A single filament 14 is twisted with the plurality of filaments 11,12,13 in a direction that is opposite to the direction of the helixes of the plurality of filaments.

As used herein, the direction of twist, lay, or a helix refers to the direction of slope of the spirals of a strand or filament when a cable is held vertically. If the slope of the spirals conform in direction to the slope of the letter "S", then the twist is called "S" or "left hand". If the slope of the spirals conform to the slope of the letter "Z", then the twist is called "Z" or "right-hand". "Lay length" is the axial distance required for a filament or strand to make one 360 degree revolution in a strand or cable. "Pitch length" is the axial distance required for a helically disposed filament to make one 360 degree revolution.

Put another way, a metallic cable according to the invention comprises a strand of identical helical shaped untwisted filaments 11,12,13 positioned beside and against each other such that each filament is in line contact with at least one other filament of said strand, the helixes of the filaments of said strand being sloped in a first direction, and a single filament 14 twisted with said strand in a direction opposite of said first direction.

FIGS. 2 to 6, which are cross-sectional views of a cable according to the invention taken along lines 2—2 to 6—6, respectively of FIG. 1, illustrate the open structure of a cable according to the invention. This open structure allows each filament to be substantially surrounded by an elastomeric substance when the cable is embedded in an elastomeric article to provide reinforcement. A substantially thorough coating of each filament not only retards the spread of corrosion if the elastomeric article is damaged, but also acts as an insulation to retard fretting, or abrasion, between the filaments which could result in the breaking of filaments or the cable itself. Abrasion of metallic filaments against one another could also generate heat to weaken the adhesion of the surrounding elastomeric material to the filaments and the cable itself.

The individual filaments of a cable according to the invention may have diameters in the range of 0.05 mm to 0.5 mm, and preferably in the range of 0.15 mm to 0.35 mm. Preferably, the single filament has the same diameter as the filaments of the plurality of filaments.

The helixes formed by the plurality of filaments have a pitch length in the range of 5 mm to 30 mm, but preferably in the range of 12 mm to 18 mm. Preferably, the pitch length of the helixes of the plurality of filaments is equal to the lay length of the single filament twisted with the plurality of filaments.

Another advantage of a metallic cable according to the invention is that it may be manufactured rapidly using a continuous operation, rather than partially forming the cable, storing it on a spool, then finishing the cable in a subsequent operation.

Figure 7:
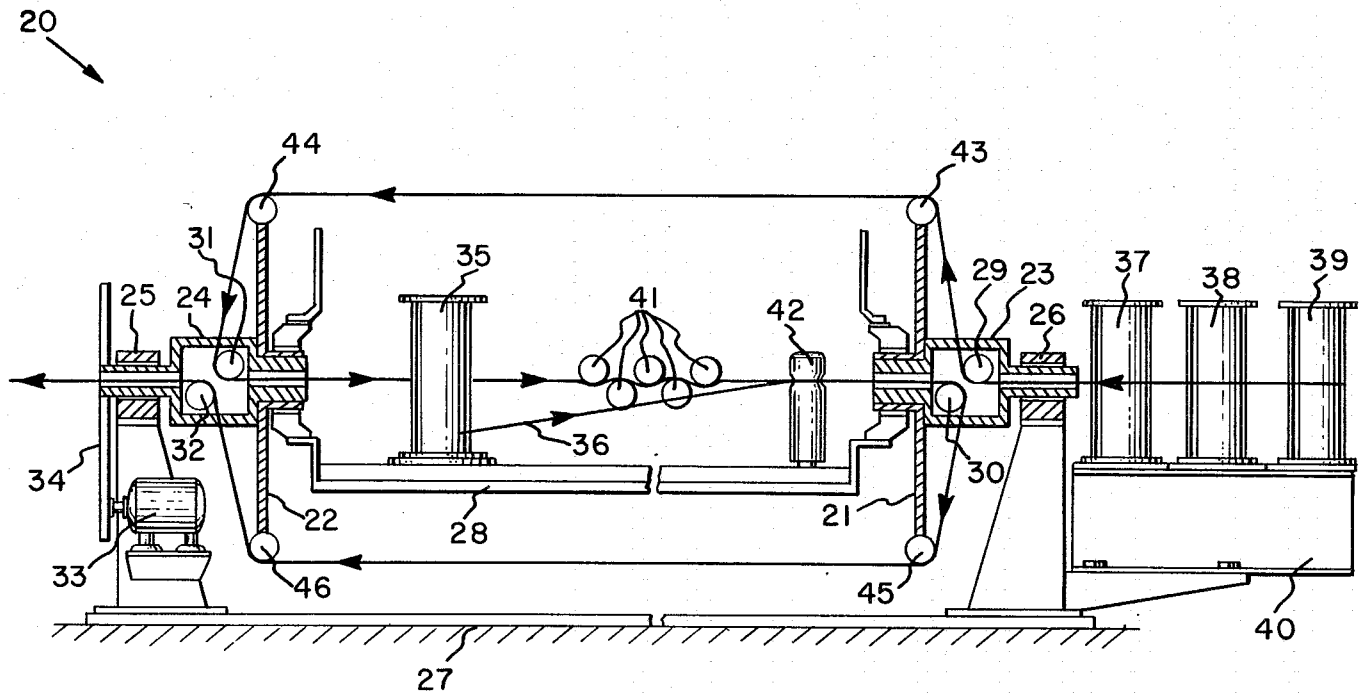
FIG. 7 is a schematic side view of an apparatus for making a metallic cable according to the invention.
Figure 8:
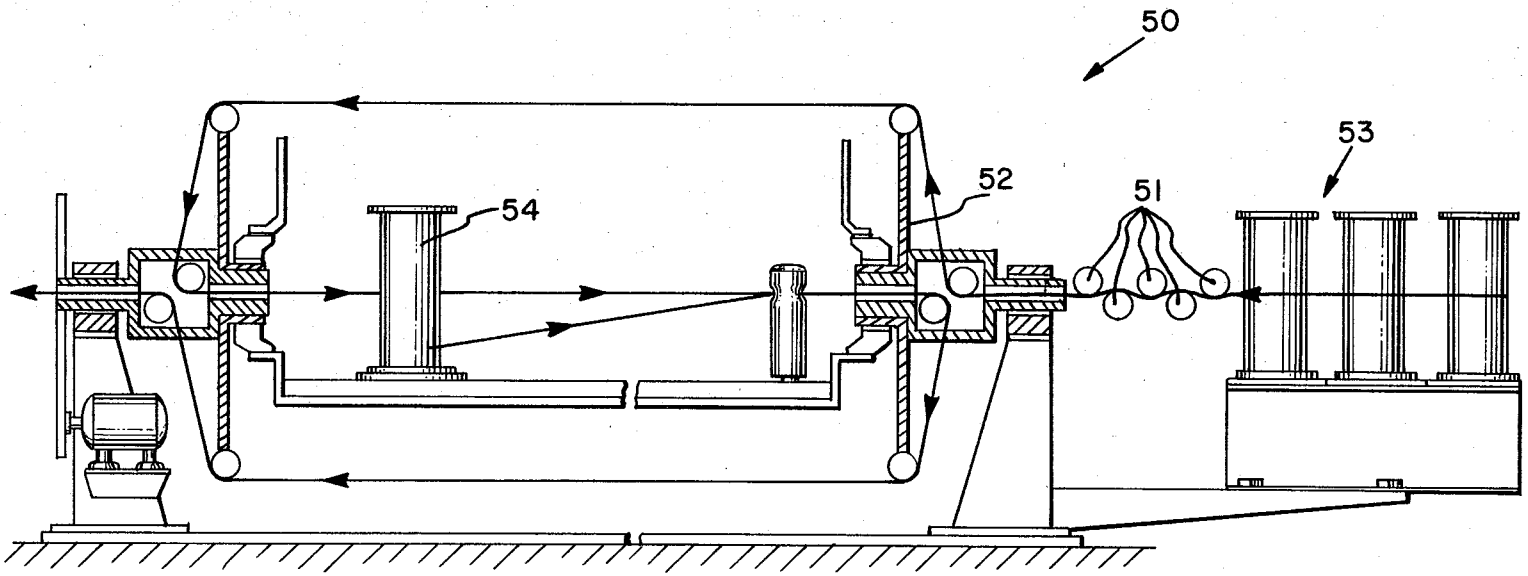
FIG. 8 is a schematic side view of another apparatus for making a metallic cable according to the invention.

Referring to FIGS. 7 and 8, there are shown schematic side views of two embodiments of an apparatus for manufacturing a metallic cable in accordance with the invention. The apparatus 20 illustrated in FIG. 7 will be described in detail, and then the distinguishing feature of the apparatus 50 illustrated in FIG. 8 will be pointed out.

A first member of the cable making apparatus 20 of FIG. 7 comprises first and second coaxial and interconnected flyers 21,22 spaced apart with respect to their axis of rotation. The rotating flyers have hollow bearings 23,24 that are rotatably attached to a means for support 25,26 that rest upon a base 27. A series of flyer pulleys 43,44,45,46 are disposed at, or near, the radially outer edges of the flyers. A pair of rotating sunken pulleys 29,30 are attached to the inside of the hollow bearing 23 of the first rotating flyer, and a pair of rotating sunken pulleys 31,32 are attached to the inside of the hollow bearing 24 of the second rotating flyer. The walls of the hollow bearings have passageways therethrough in the regions of the sunken rotating pulleys to allow filaments, strands, or a cable to pass from the interior to the exterior of the hollow bearings. The rotating sunken pulleys guide metallic filaments through the hollow bearings in directions towards or away from the radially outer periphery of the respective flyer. A means for rotating, such as an electric motor 33 connected to the bearing of one of the flyers by a combination of pulleys and a belt 34 causes the flyers to rotate about their mutual axis.

A second member of the cable making apparatus comprises a non-rotating cradle 28 swingably suspended from the hollow bearings of the flyers, and a bobbin means 35 attached to the cradle for supplying a metallic filament 36. While a single bobbin means is shown attached to the cradle in the drawing, it is understood that the number of bobbin means actually employed is dependent upon the particular cable construction that is to be manufactured. Although the bobbin means illustrated in the drawing has a vertically oriented axis of rotation, it is understood that the axis of rotation of the bobbin means may be horizontal and perpendicular to the axis of the flyers, without deviating from the invention. An idler roll 42 may be attached to the cradle to guide filaments along the axis of rotation of the flyers.

A third member of the cable making apparatus comprises a plurality of bobbin means 37,38,39 attached to a stand 40 that is disposed at the end of the first member of the cable making machine nearest to the first flyer 21. The plurality of bobbin means supply a plurality of metallic filaments. While three bobbin means are shown attached to the stand in the drawing, it is understood that the number of bobbin means actually employed is dependent upon the particular cable construction that is to be manufactured. Although the plurality of bobbin means 37,38,39 illustrated in the drawing have vertically oriented axes of rotation, it is understood that the axes of rotation of the plurality of bobbin means may be horizontal and perpendicular to the axis of rotation of the flyers, without deviating from the invention.

A forth member of the cable making machine comprises a means for permanently forming the plurality of metallic filaments, supplied by the plurality of bobbin means of the third member, into helixes. In the embodiment illustrated in FIG. 7, this fourth member comprises a plurality of kill rolls 41 attached to the non-rotating cradle 34. As used herein, "kill rolls" are understood to mean a series of freely rotating pulleys aligned in two parallel rows such that the geometric centers of the pulleys of one row are positioned midway between the geometric centers of the pulleys of the other row. The distance between the two rolls of pulleys is adjustable to permit the manufacturing of various cable constructions. The "kill-rolls" function is to mechanically deform the filaments of a strand or cable to permanently fix the positions of the filaments with respect to one another and relieve the stresses in the strand or cable.

A fifth member of the cable making machine comprises a means for collecting a finished cable such as a driven spool (not shown) and a means for drawing the metallic filaments supplied by the bobbin means of the second and third members past, around and through the components of the cable making apparatus, such as a capstan (not shown).

The cable making apparatus 50 illustrated in FIG. 8 is very similar to that illustrated in FIG. 7, with the exception that the fourth member, that is the means for permanently forming the plurality of filaments supplied by the bobbin means of the third member into helixes, is different. The fourth member of the cable making apparatus of FIG. 8 is a preformer 51 disposed between the first member 52 and the third member 53. As used herein, a "preformer" is understood to mean a series of rollers or pins aligned in substantially the same manner as the kill-rolls 41 of the apparatus 20 of FIG. 1, such that the filaments of a strand passing through the preformer are permanently deformed into helixes. After forming the plurality of filaments into helixes the preformer guides them towards a sunken rotating pulley attached inside the hollow bearing of the first flyer.

A metallic cable according to the invention may be manufactured by using a cable making apparatus of the type illustrated in FIG. 7. A plurality of metallic filaments are drawn from a plurality of bobbin means, 37,38,39 false twisted, and formed into identical helixes of a given hand and pitch. The helixes are coaxial, and each filament is in line contact with at least one other filament. The plurality of metallic filaments are formed into helixes by guiding them around a rotating sunken pulley 29 located in the hollow bearing 23 of the first rotating flyer 21 to impart a twist to the plurality of filaments in a first direction, then guiding the plurality of filaments towards the radially outer periphery of the first rotating flyer. A flyer pulley 43 of the first rotating flyer directs the plurlity of filaments towards the radially outer periphery of the second rotating flyer. A flyer pulley 44 of the second rotating flyer directs the plurality of filaments towards a rotating sunken pulley 31 located in the hollow bearing of the second flyer. The plurality of filaments are guided next to and partially around the sunken rotating pulley 31 located in the hollow bearing of the second flyer to impart a second twist to the plurality of filaments in the first direction and direct the plurality of filaments through the hollow bearing of the second flyer in a direction going towards the first flyer. The plurality of filaments are passed through a series of kill rolls 41 to permanently form the filaments into helical configurations, then directed into the hollow bearing of the first flyer. This imparting of two twists into the plurality of filaments for each revolution of the flyers is referred to in the art as the "two for one twist principle".

A single metallic filament 36 is drawn from a bobbin means 35 located on the non-rotating cradle of the cable-making apparatus. The single filament is guided through the hollow bearing 23 of the first flyer along a path parallel with the axis of rotation of the flyers.

The plurality of metallic filaments and the single metallic filament are guided partially around a rotating sunken pulley 30 located in the hollow bearing of the first rotating flyer to twist the plurality of filaments with the single filament in a second direction that is opposite to the direction that the filaments of the plurality of filaments were twisted together. Therefore, the filaments of the plurality of filaments are partially untwisted from one another while retaining their helical configuration due to their passage through the series of kill rolls 41. At this point, the strand comprising the plurality of filaments and the single filaments are considered to be a cable. The cable is guided towards the radially outer periphery of the first rotating flyer and a flyer pulley 45 redirects the cable towards the radially outer periphery of the second rotating flyer. A flyer pulley 46 of the second rotating flyer directs the cable towards a rotating sunken pulley 32 located in the hollow bearing of the second flyer.

The cable is guided partially around the rotating sunken pulley 32 located in the hollow bearing of the second flyer to further twist the plurality of filaments and the single filament in said second direction, simultaneously completely untwisting the filaments of the plurality of filaments from one another. The finished cable is then wrapped onto a means for collecting a finished cable, such as a driven spool (not shown).

If a cable making apparatus 50 of the type illustrated in FIG. 8 is employed in the manufacture of a cable according to the invention, the plurality of cables supplied by a plurality of spools are formed into helixes by passing the plurality of filaments through a pre-forming apparatus 51 disposed between the bobbins of the third member 53 of the cable making apparatus and the first flyer 52. The plurality of filaments are then false twisted and twisted with a single filament, supplied by a bobbin means 54 attached to the non-rotating cradle, in the manner already described with the exception that no kill rolls are employed since the pre-former has already permanently formed the plurality of filaments into helixes.

While certain representative embodiments and details have been shown for the purpose of illustrating the invention, it will be apparent to those skilled in the art that various changes and modifications may be made therein without departing from the spirit or scope of the invention.

What is claimed is:

1. A metallic cable for reinforcing an elastomeric article comprising: (a) a strand of identical helical shaped untwisted filaments positioned beside and against each other such that each filament of said strand is in line contact with at least one other filament of said strand, the helixes of the filaments of said strand being sloped in a first direction; and, (b) a single filament twisted with said strand in a direction opposite to said first direction.

2. A metallic cable according to claim 1 wherein each filament of said strand, as well as said single filament, has a diameter in the range of 0.05 mm to 0.5 mm.

3. A metallic cable according to claim 1 wherein each filament of said strand, as well as said single filament, has a diameter in the range of 0.15 mm to 0.35 mm.

4. A metallic cable according to any one of claims 1, 2 or 3 wherein said single filament has the same diameter as the filaments of said strand.

5. A metallic cable according to any one of claims 1, 2 or 3 wherein the helixes of the filaments of said strand have a pitch length in the range of 5 mm to 30 mm.

6. A metallic cable according to claim 5 wherein said single filament is twisted with said strand with a lay length that is equal to said pitch length.

7. A metallic cable according to any one of claims 1, 2 or 3 wherein the helixes of the filaments of said strand have a pitch length in the range of 12 mm to 18 mm.

8. A metallic cable according to claim 7 wherein said single filament is twisted with said strand with a lay length that is equal to said pitch length.

9. A metallic cable according to either of claims 2 or 3 wherein said single filament is twisted with said strand with a lay length that is equal to said pitch length.

10. A metallic cable according to claim 1 wherein the helixes of the filaments of said strand have a pitch length, and said single filament is twisted with said strand with a lay length that is equal to said pitch length.

11. A method of manufacturing a metallic cable comprising the steps of:

(a) drawing a plurality of metallic filaments from a bobbin means, false twisting and forming said plurality of filaments into identical helixes having a given hand and pitch, said helixes being coaxial and each said filament being in line contact with at least one other of said filaments;

(b) drawing a single metallic filament from a bobbin means located on a non-rotating cradle of a cable making apparatus, said cradle being suspended between first and second coaxial rotating flyers with hollow bearings, and guiding said single filament through the hollow bearing of one of said flyers along a path parallel with the axis of rotation of said flyers;

(c) guiding said plurality of metallic filaments and said single metallic filament around a rotating sunken pulley located in the hollow bearing of said first rotating flyer to twist said single filament with said plurality of filaments and form a cable, then guiding said cable towards the radially outer periphery of said first rotating flyer where said cable is redirected towards the radially outer periphery of said second rotating flyer where said cable is directed towards a rotating sunken pulley located in the hollow bearing of said second flyer;

(d) guiding said cable partially around the rotating sunken pulley located in the hollow bearing of said second flyer to further twist said single filament with said plurality of filaments; and (e) wrapping said cable onto a means for collecting a finished cable.

12. A method of manufacturing a metallic cable according to claim 11 wherein said plurality of metallic filaments are formed into helixes by passing said plurality of filaments through a pre-forming apparatus disposed between the bobbins and the first flyer cable making apparatus.

13. A method of manufacturing a metallic cable according to claim 11 wherein said plurality of metallic filaments are formed into helixes by guiding said plurality of filaments partially around a rotating sunken pulley located in the hollow bearing of said first rotating flyer to impart a twist to said plurality of filaments then guiding said plurality of filaments towards the radially outer periphery of said first rotating flyer where said plurality of filaments is directed towards the radially outer periphery of said second rotating flyer where said plurality of filaments is directed towards a rotating sunken pulley located in the hollow bearing of said second flyer, then guiding said plurality of filaments partially around the rotating sunken pulley located in the hollow bearing of said second flyer to further twist said plurality of filaments and direct said plurality of filaments through said hollow bearing of said second flyer in a direction going towards said first flyer, passing said plurality of filaments through a series of kill rolls to permanently set said filaments into helical configurations, then directing said plurality of filaments into the hollow bearing of said first flyer.

14. An apparatus for manufacturing a metallic cable comprising:

(a) a first member comprising first and second coaxial and interconnected flyers spaced apart with respect to said axis, said flyers having hollow bearings that are supported by a means for providing support, a pair of rotating sunken pulleys attached inside the hollow bearing of each flyer to guide metallic filaments through said hollow bearings and in directions towards or away from the radially outer periphery of the respective flyer, and a means for rotating said flyers about said axis;

(b) a second member comprising a non-rotating cradle suspended from the hollow bearings of said flyers, and a bobbin means attached to said cradle for supplying a metallic filament;

(c) a third member comprising a plurality of bobbin means for supplying a plurality of metallic filaments, said plurality of bobbin means being attached to a stand that is disposed at the end of said first member nearest to said first flyer;

(d) a fourth member comprising a means for permanently forming the plurality of metallic filaments supplied by the plurality of bobbin means of said third member into helixes;

(e) a fifth member comprising a means for collecting a finished cable and a means for drawing the filaments supplied by the bobbin means of said second and third members past, around and through the components of said cable making apparatus.

15. An apparatus for manufacturing a metallic cable according to claim 14 wherein said fourth member comprises a preformer disposed between said first member and said third member, said preformer guiding said plurality of filaments towards a rotating sunken pulley attached inside the hollow bearing of said first flyer.

16. An apparatus for manufacturing a metallic cable according to claim 14 wherein said fourth member comprises a plurality of kill rolls to permanently impart a helical shape to said plurality of filaments and untwist said plurality of filaments.

* * * * *